US005586672A

United States Patent [19]

Schneider et al.

[11] Patent Number: 5,586,672

[45] Date of Patent: Dec. 24, 1996

[54] TUBE MADE OF PLASTICS MATERIAL HAVING A TEARABLE CAP, SAID TUBE WITH A COVER

[75] Inventors: Bernard Schneider; René Hoslet, both of Sainte Menehould, France

[73] Assignee: Cebal, S.A., Clichy, France

[21] Appl. No.: 516,249

[22] Filed: Aug. 17, 1995

Related U.S. Application Data

[63] Continuation of Ser. No. 79,675, Jun. 18, 1993, abandoned.

[30] Foreign Application Priority Data

Jun. 19, 1992 [FR] France ..... 92 07839

[51] Int. Cl.[6] ..... B65D 47/10

[52] U.S. Cl. ..... 215/250; 222/541.6

[58] Field of Search ..... 222/541; 220/258, 220/274; 215/215, 201, 204, 209, 250

[56] References Cited

U.S. PATENT DOCUMENTS

| | | | |
|---|---|---|---|
| 1,327,190 | 1/1920 | Bigoney . | |
| 2,769,583 | 11/1950 | Darlington, Jr. . | |
| 3,124,280 | 3/1964 | Stull . | |
| 3,272,366 | 9/1966 | Ikeda . | |
| 3,460,724 | 8/1969 | Chmela . | |
| 3,777,949 | 12/1973 | Chiquiari-Arias . | |
| 4,157,765 | 6/1979 | Golebiewsky | 220/268 |
| 4,248,227 | 2/1981 | Thomas . | |
| 4,527,700 | 7/1985 | Jupin . | |
| 4,632,267 | 12/1986 | Fowler et al. . | |
| 4,666,063 | 5/1987 | Holoubek . | |
| 4,688,703 | 8/1987 | Bayer | 220/541 |
| 4,773,548 | 9/1988 | Deussen . | |
| 4,854,458 | 8/1989 | Differ . | |
| 4,903,855 | 2/1990 | Ducay et al. . | |
| 5,221,029 | 6/1993 | Stull . | |
| 5,240,155 | 8/1993 | Mueller et al. . | |
| 5,348,183 | 9/1994 | Luch et al. . | |

FOREIGN PATENT DOCUMENTS

| | | |
|---|---|---|
| 1444848 | 8/1976 | United Kingdom . |
| 2039267 | 1/1979 | United Kingdom . |

*Primary Examiner*—Joseph M. Moy
*Attorney, Agent, or Firm*—Paul R. Audet

[57] ABSTRACT

The invention relates to a tube (1) of which the head (2) comprises an impermeable cap (5) which may be torn by twisting, characterized in that this cap has a lateral surface (5) of polygonal contour (6) inclined at less than 10° to the axis (16) of the tube (1) and a tear zone (10) contained between the lateral surface (50) and an internal surface (11) of the cap (5) comprising at least one thin portion having a minimum thickness of 0.05 to 0.18 mm and at least one portion (9, 9') which is at least 1.5 times thicker.

The invention also relates to the tube (1) accompanied by a cover maintaining the integrity of the periphery of the cap and comprising a key fitting over the cap so as to tear it by twisting, and to its use in particular for storing and dispensing liquids in metered droplets. The tube is typically used for storing and dispensing medical or cosmetic liquids.

23 Claims, 2 Drawing Sheets

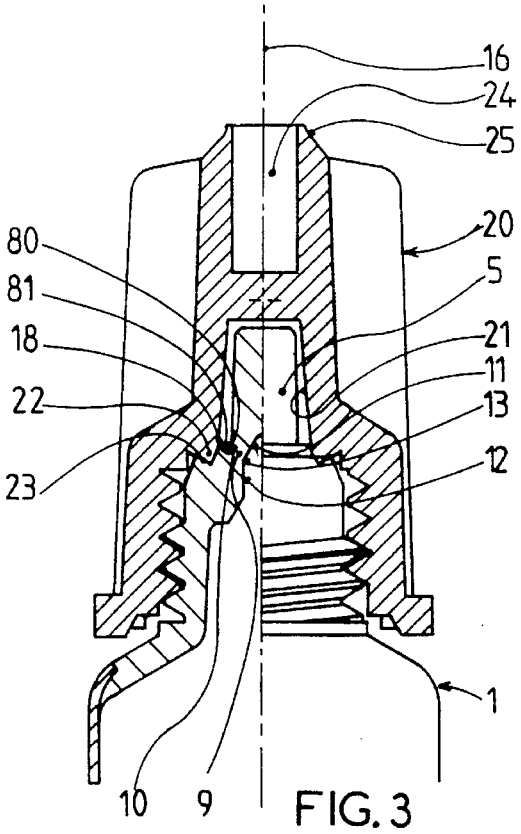
FIG. 3
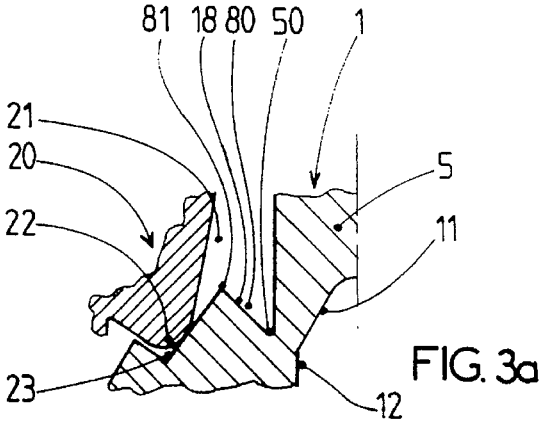
FIG. 3a
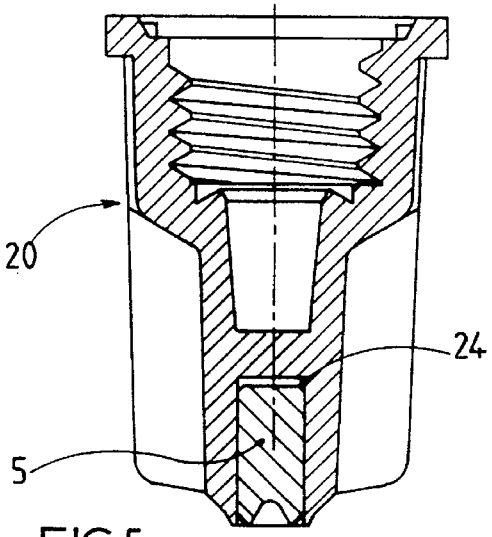
FIG. 5
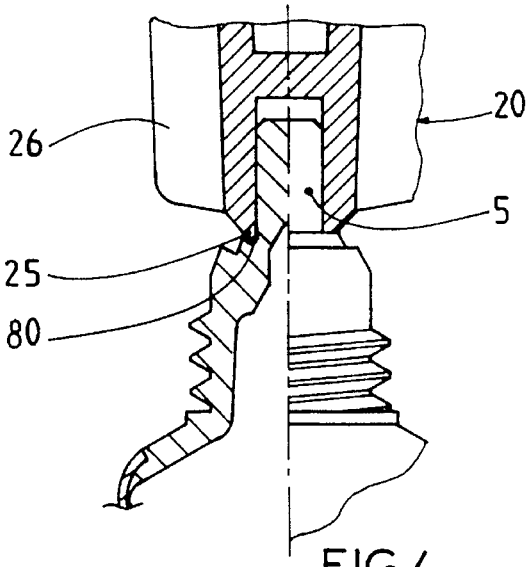
FIG. 4
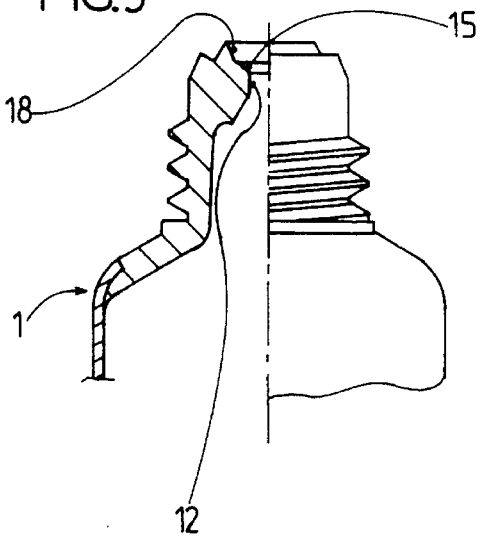

TUBE MADE OF PLASTICS MATERIAL HAVING A TEARABLE CAP, SAID TUBE WITH A COVER

This application is a continuation of U.S. application Ser. No. 8/079,675, filed Jun. 18, 1993 now abandoned.

The invention relates to a tube made of plastics material topped by a tearable cap sealing its outlet orifice, this tube possibly being equipped with a stopper or cover comprising a key allowing this cap to be fitted into the key and torn from the tube when the key is rotated.

A tube of this type associated with a cover fitting by means of internal reliefs over reliefs carried by the lateral surface of the cap is known from EP-B-119145 which corresponds to U.S. Pat. No. 4,527,700. The base of the cap is connected by a tearable zone at the edge of the orifice of the tube neck, and the rotation of the cover fitted on the cap, by its complementary reliefs, allows the cap to be entrained, breaking said zone by twisting. The cap is held in the cover when it is force-fitted in the internal reliefs of the cover. The orifice diameter was typically from 2.5 to 10 mm.

In the case of orifices often having smaller diameters, typically of 1.2 to 4 mm, the rigidity of the impermeable tearable cap poses problems as well as the ability to grip it. Furthermore, in the case of tubes containing products to be delivered in droplets, the portion for detachment of the droplets should preferably be protected. The applicants have attempted to develop a tube having a tearable tight or integral cap solving these problems.

STATEMENT OF THE INVENTION

The invention relates to a tube made of plastics material having a head topped or sealed by a tight or integral cap which may be torn by twisting, wherein the cap has, down to its base connected to said head, a lateral surface of convex planar polygonal contour, this surface preferably being formed by generatrices inclined at less than 10° to the axis of the tube when moving away from said base, and wherein said cap has a tear zone contained between said lateral surface and an internal surface having circular sections perpendicularly to said axis, these surfaces together defining at least one thin portion of minimum thickness of between 0.05 and 0.15 mm and one portion of maximum thickness at least 1.5 times greater than said minimum thickness.

Owing to the structure produced, the cap is sufficiently rigid down to its connection with the head of the tube. The thicker portions of its internally hollow base produce this rigidity and facilitate the injection and obtaining of intermediate parts or portions which are much thinner but are still compact and tight or integral and which form forming sites for initiation of the breakage by twisting. As the cap is rigid and has a cylindrical or slightly conical shape, the gripping thereof, preferably the fitting of an appropriate key over it, is facilitated and handling is not likely to bend it and damage its immediate periphery.

In practice, tests for approval of each material making up the interior of the tube have to be carried out vis-a-vis the product contained, so the tube head equipped with the cap according to the invention is preferably moulded on a skirt of which the internal surface is formed by a plastics material identical to that of the head. In order to tear the cap in a ductile manner and without residual deformation affecting its immediate periphery, the common plastics material which can be employed for the moulded-on head and for at least the interior skirt preferably is low density polyethylene selected from the group consisting of low density polyethylene having a density of between 0.88 and 0.93 g/cm$^3$ and low density linear polyethylene.

According to a typical solution which is easy to implement and provides particularly satisfactory rigidity and tearability, the external surface of the tear zone has a square contour and its hollow internal surface has, perpendicular to the longitudinal axis of the tube and the cap, successive circular sections centered relative to this square external surface, the progressive or gradual thinning and thickening of the wall contained between this external surface and internal surface resulting in a maximum thickness of each of the two thick portions which is 2.5 to 4 times greater than the minimum thickness of each of the two thin portions contained between these thick portions. Said hollow internal surface is typically a surface of revolution round said axis.

In the case of tubes for delivering a liquid in droplet form, the base of the cap is connected to the head of the tube in a flared annular depression in this head, the diameter of the emergent end of this depression being less than 2 mm greater than the external width of the base of the cap and the height of this cap exceeding this end by a height or distance at least equal to its diameter. The relief of the cap protects the depression which is the immediate periphery of its base from damage which might be caused by handling. The lateral wall of the depression is typically truncated cone shaped and constitutes the top of a truncated cone for forming droplets which will be completed, toward the bottom and at the interior, by the tear or breakage surface of the cap produced by the opening of the tube. The micro-roughness of this tear surface produces sites for attachment of droplets of liquid and allows them to form more easily and to expand, yielding droplets metered at 19 to 21 droplets per cm$^3$. The diameter of the emergent end of the depression is typically between 2.5 and 7 mm, the external width of the base of the cap being between 2 and 6 mm.

Generally speaking, the internal surface of the cap is or belongs to or includes an arch forming the reverse of or an interior hollow at the base of the cap, this arch having a height which is low in comparison with the height of the cap and is typically less than 1.3 mm and being connected to or communicating with a circular cylindrical axial internal surface comprising or forming part of the orifice of the tube after tearing of the cap.

If the base of the cap is surrounded by the above-described flared annular depression, said depression preferably has a truncated cone shaped lateral surface which will be extended by the lateral surface for breakage of the cap, this extended surface itself being substantially truncated cone shaped, so as to form a surface for producing successive droplets as described hereinbefore at the end of the circular cylindrical axial internal surface of the tube head, the unit allowing the expulsion of calibrated liquid droplets.

The cap of the tube may be gripped or engaged by any means and may then be broken by twisting. The tube is preferably accompanied by or equipped with a cover which covers the head of the tube and the cap, the cover having no contact with this cap, and this cover preferably has a hollow cavity at its top constituting a key which is capable of encompassing or surrounding the cap and rotating it, when the cover is released from the tube, inverted placed on the cap and rotated to thereby allow, the cap to be broken from the tube. For correct rotation of the cover, the inverted cover presses axially on the head of the tube, and it is desirable for the driven surface of the cap which is driven by the key to have a height which is at least twice the diameter or external width of its base and also for the conicity of the cap, which widens towards it base, to be slight, having a half cone angle of less than 10°, as already mentioned.

If this half angle is smaller than 5° or zero, the members are fitted together merely by being driven into one another, by moving the cover key, preferably fully, axially onto the cap. To maintain the tidiness of premises or of the environment, the generatrices of the lateral surface of the cap are preferably inclined at less than 2° to the axis, the key of the tube thus fitting over the cap with a slight clearance, preferably between 0.05 and 0.2 mm at the diameter, and holding it there after the breakage thereof. It can be seen that this holding is linked to or due to the polygonal shape and the relative length of the engagement of the cap in the cover and is achieved without force.

To allow even better preservation of the state of the flared annular depression bordering the cap, it is advisable to equip the top of the cover with a terminal external cone surrounding the cover cavity or hollow key, this cone fitting in the annular depression when the key of the cover surrounds the cap.

According to a further improvement of the cover, the state of the flared annular depression is preserved better during storage of the tube covered by this cover by providing, on the head of the tube, a peripheral annular groove which surrounds the flared annular depression as well as a rib preferably an annular internal rib on the cover fixed on the tube, for example, by screwing, such that the rib which engages in said annular groove when the cover is fixed fully on the tube. This groove and this rib ensure that the tube is impermeably sealed by the cover after the cap has been torn.

To enable the cap to be rotated by the cover and this cap to be torn and for precision moulding of the cover it is preferable to use a harder or more rigid material for the cover than for the head of the tube, typically: cover of high density polyethylene or polypropylene in the case of a tube head of low density polyethylene or low density linear polyethylene. The plastics material of the tube head is preferably identical to the plastics material forming the interior of the tube skirt, as already mentioned. The cap which is less hard than the cover is held there more easily.

Two important types of use should be mentioned:

use of the tube alone or with cover, without the need for a flared annular depression surrounding the cap, for storing and dispensing liquids intended for ocular or cosmetic purposes;

use of the tube, with an annular flared depression for forming droplets, for storing and dispensing, dropwise, a liquid vaccine or a homeopathic liquid.

ADVANTAGES OF THE INVENTION

The tight or integral tube cap is both tearable and rigid, even in the region of its tear zone, preventing it from bending during handling.

The periphery of the base of the cap, in particular a dish for the formation of droplets, does not run the risk of being damaged by handling.

The rigidity of the entire cap and its polygonal contour facilitate the gripping thereof despite its small dimensions.

This polygonal shape and its relatively great length facilitate the fitting thereof in the key of the cover and the holding thereof despite a small clearance which also facilitates this fitting.

EXAMPLES

FIG. 3 shows a second tube according to the invention covered by its cover with an axial section in its left-hand half and an axial section of the cover but not of the tube in its right-hand half.

FIG. 3*a* is a partial enlarged view.

FIG. 4 shows the same tube with the same half views, the inverted cover surrounding the cap.

FIG. 5, an exploded view, shows the tube with the same half views and the removed cover after breakage of the cap, the cap remaining trapped by the cover which is cut axially.

Figure 1:
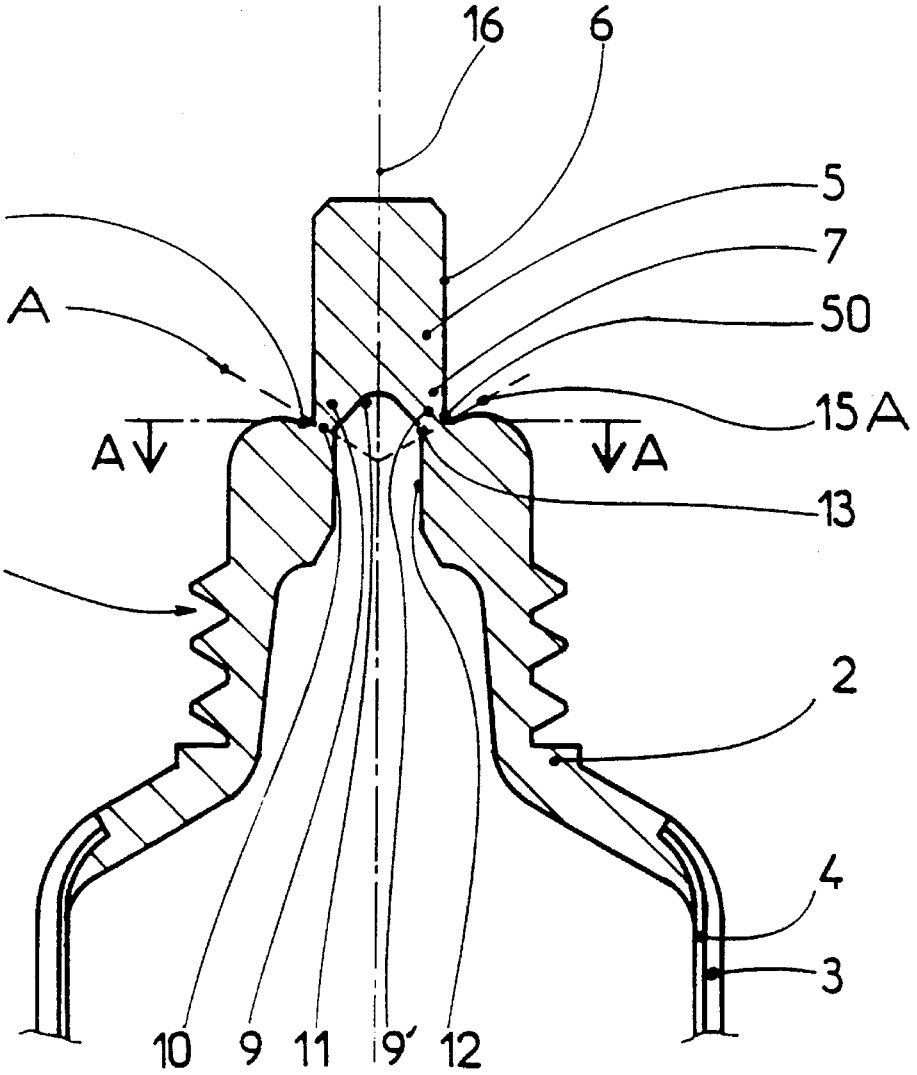
FIG. 1 shows a tube according to the invention equipped with its cap in an axial section.
Figure 2:
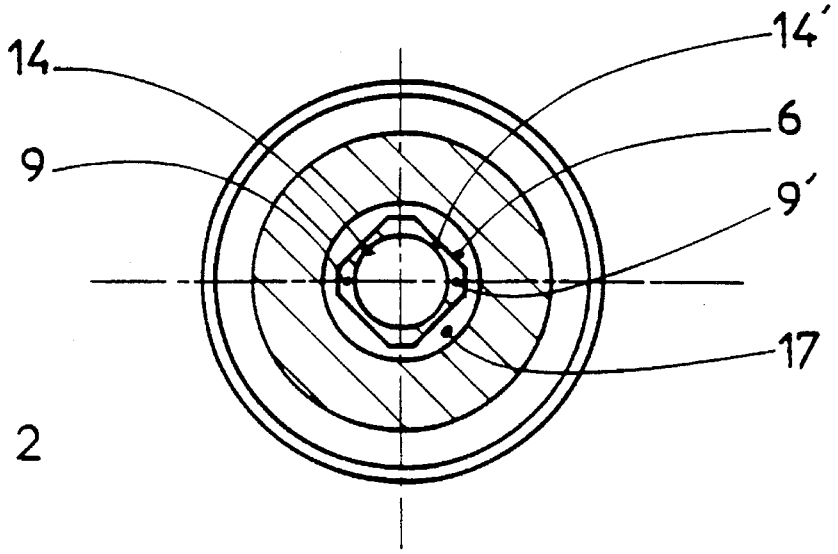
FIG. 2 is a cross section of the cap in the region of its future tear in a section A—A perpendicular to the axis.

1) FIG. 1 shows a tube 1 of which the head 2 of low density polyethylene (LDPE) is moulded onto a skirt 3 having a lining 4 also of LDPE. This head 2 is topped by a tearable cap 5 having a lateral surface 6 of substantially square contour (FIG. 2) with a slight annular hollow or depression 8 round its base 7. The axial section in FIG. 1 shows two thick portions 9 and 9' of the breakage or tear zone 10 of the cap, the zone between, on the one hand, the arch 11 of the cap 5 and the circular or cylindrical axial internal surface 12 which is connected to this arch at 13 and, on the other hand, the foot of the exterior of the cap 5 constituting the bottom 50 of the depression 8. The four portions such as 9 and 9' having a maximum thickness of 0.4 mm are shown in the section A—A in FIG. 2 passing in the same plane perpendicular to the axis 16 through the cap foot or bottom 50 and they alternate with four thin portions such as 14 and 14' having a minimum thickness of 0.12 mm. The breakage of the cap 5 by twisting will be localised along a breakage line represented by a dashed line 15A in the shape of a truncated cone which is slightly inclined to the axis 16, extends from the bottom of the hollow 8 in the vicinity of the circular connection 13 and corresponds to the minimum thicknesses of 0.10 mm of the thin portions 14 and 14' as well as the thick portions 9 and 9' of which the maximum thickness is only 0.33 mm. The resulting truncated cone shaped breakage surface 15 is shown in FIG. 5. The square contour of the cap allows widening 17 of the depression 8 (FIG. 2) round its base 7 so that the truncated cone shaped breakage surface 15 of the break has slight irregularities without affecting the flow of a contained liquid and the formation of droplets. Generally speaking, the cap may also be connected to the head of the tube without an annular depression round its base, the radius of this connection typically being smaller than 0.5 mm.

2) FIGS. 3 and 4 show a second tube also designated by 1, the only modification being the replacement of the slight hollow 8 (FIG. 1) by an annular depression 80 of which the truncated cone shaped lateral surface 18 is at 45° to the longitudinal axis 16, this surface 18 forming, with the breakage surface 15 of the cap (FIG. 5), a dish 18 and 15 for the formation of droplets. The dimensions of interest in the tube 1 were as follows:

cap 5 having a square cross section of 2.5×2.5 mm with slight bevels at the corners and having a total height, from its external foot forming the bottom 50 of the annular depression 80, of 5 mm;

depression 80 having an opening diameter of 3 mm and a depth of 0.5 mm;

circular cylindrical axial orifice portion 12 having a diameter of 1.5 mm connected at 13 to the arch 11 having a height of 1 mm;

alternate thin portions such as 14 (FIG. 2) and thick portions such as 9 of the tear zone or breakage zone 10, having the same thickness at the level of the bottom 50 of the annular depression 80 (FIG. 3*a*) and along the future tear or cone shaped breakage surface 15 (FIG. 5) formed along truncated cone shaped breakage line 15A shown in FIG. 1;

the tube neck has a diameter of 8 mm and its skirt 3 a diameter of 13 mm.

FIG. 3 also shows the cover 20 of PP (polypropylene) screwed home on or fully axially-threadedly secured to the tube 1. This cover comprises a truncated cone shaped cavity 21 which covers the cap 5 without making contact with it and is bordered preferably about the mouth of cavity 21, by a depending rib 22 which as the cover is threadedly secured to the tube, is driven or moved into, and, in the screwed or threadedly secured position, sits in a peripheral annular groove 23 of the tube 1 the groove 23 encircling annular depression 80, this driving in acting beyond the open end 81 of the depression 80 (FIGS. 3 and 3*a*). Because of this feature, depression 80 and the cap are perfectly protected from impacts or damage during the screwing of the cover 20.

The cover 20 also comprises a hollow cavity 24 of square section which opens at its top and has a clearance of 0.08 mm over its width relative to the cap and a depth of 6 mm. This cavity 24 is surrounded by an external cone 25 whose narrow end fits in the annular depression 80 (FIG. 4) when the cover 20 fits over the cap 5 and breaks it by rotation of this cap. This breakage is easily achieved whatever the direction of rotation of the cover 20, the cover conveniently being held by two flattened wings or ribs 26.

4) FIG. 5 shows the tube 1 and the cover 20 from FIGS. 3 and 4 after breakage of the cap 5 which is now trapped by the hollow cavity or key 24 of the cover 20. The orifice comprising axial internal surface 12 and the dish shaped droplet formation surface 15 and 18 for the formation of droplets now allow the delivery of metered droplets and the cover 20 allows the tube 1 to be resealed after each dispensing operation.

INDUSTRIAL APPLICATION

Tubes of plastics material for the storage and dispensing of medical, paramedical or cosmetic liquids, in particular liquid vaccines to be dispensed in metered droplets.

We claim:

1. A tube (1) made of plastics material having a longitudinal axis (16), a head (2) which has a cylindrical axial internal surface (12), the head being sealed by an integral cap (5) which is connected to the head and adapted to be torn therefrom by twisting to leave an orifice in the head, the cap (5) having a base (7) where the cap (5) is connected to the head (2), an exterior lateral surface (6) of convex planar polygonal contour extending down to the base (7), an internal surface (11) adjoining the cylindrical axial internal surface (12), and being a surface of revolution about the axis and in the form of an arch which extends up into the cap, and a tear zone (10) contained between and defined by the cap convex planar polygonal exterior lateral surface (6), the cap internal surface (11) and the head internal surface (12), the external lateral surface (6) and the internal surface (11) at the connection between the base of the cap and the head providing the tear zone with successive gradually thinning and thickening thin and thick portions (e.g. 14, 14' and 9, 9') extending about the axis (16).

2. A tube (1) according to claim 1, in which the head (2) is moulded onto a skirt (3) having an internal surface (4), the plastics material of the head (2) being identical to the plastics material forming the internal surface (4) of the skirt (3), this plastics material being a low density polyethylene selected from the group consisting of low density polyethylene having a density of between 0.88 and 0.93 g/cm$^3$ and low density linear polyethylene, and the thin portions have a minimum thickness of between 0.05 and 0.18 mm and the thick portions have a maximum thickness of at least 1.5 times greater than the minimum thickness of the thin portions.

3. A tube (1) according to claim 1, in which the tear zone (10) comprises at least two of said thin portions (9 and 9'), the maximum thickness of each thick portion (9, 9') being 2.5 to 4 times greater than the minimum thickness of each thin portion (14, 14').

4. A tube (1) according to claim 1 or 3, in which the base (7) of the cap (5) is connected to the head (2) in a flared annular depression (8, 80) of the head (2), the depression having an emergent end whose diameter is less than 2 mm greater than the external width of the base (7) of the cap (5) and the height of said cap (5) is at least equal to the diameter of the annular depression (8, 80).

5. Tube (1) according to claim 4, in which the diameter of the emergent end of the depression (80) is between 2.5 and 7 mm, the external width of the base (7) of the cap (5) being between 2 and 6 mm.

6. A tube (1) according to any one of claims 1 to 3, wherein the arch of the internal surface (11) has a height of less than 1.3 mm, and a portion of the surface (12) forms part of the orifice of the tube (1) when the cap (5) is torn from the head.

7. A tube (1) according to claim 4, in which the flared annular depression (80) of the head (2) has a truncated cone shaped lateral surface (18) which declines from the emergent end toward the axis and the base (7) of the cap (5) and, upon tearing of the cap from the head, extends and localizes breakage substantially along a truncated cone shaped breakage line through the tear zone (10) to form a truncated cone shaped breakage surface (15) of the cap (5), the lateral surface (18) and the breakage surface (15) together forming an extended truncated cone shaped dish-shaped droplet formation surface (15, 18) adjacent the top end of the head (2), which communicates with the internal surface (12) of the head (2), the extended truncated cone shaped dish-shaped droplet formation surface (18, 15) and a portion of the axial internal surface (12) comprising the orifice and allowing the expulsion of metered liquid droplets from liquid when the same is contained within the tube.

8. A tube (1) according to any one of claims 1 to 3, wherein the lateral surface (6) is formed by generatrices inclined at less than 10° to the axis of the tube (1) and the tube is accompanied by a cover (20) which is detachably fixed onto the tube (1), the cover (20) covering the cap (5) of the tube (1) without making contact with the cap and comprising a hollow cavity opening at its top and constituting a key (24) adapted to surround and engage a portion of the lateral surface (6) of the cap (5), a portion of the lateral surface (6) of the cap having a surface adapted to be engaged and rotatingly driven by the cover (20), the key having a height which is at least twice the external width of the base of the cap (5) and an inclination to the axis of less than 10°, such that when the cover (20) is removed from the tube, inverted, placed on the cap and rotated, the cap (5) is engaged and rotatingly driven by the cover and is thereby torn from the head.

9. A tube (1) accompanied by a cover (20) according to claim 8 in which the cover cavity is defined by a surface having an inclination to the axis (16) of less than 10° and the generatrices of the external lateral surface (6) of the cap (5) are inclined at less than 5° to the longitudinal axis (16), the key (24) of the cover (20) fitting fully over the cap (5) by being placed over the cap and engagingly seated thereon.

10. A tube accompanied by a cover (20) according to claim 9, in which the generatrices of the lateral surface (6) of the cap (5) are inclined at most at 2° to the axis (16), the key (24) being adapted to fit fully over the cap (5) and to hold the cap in the key after use of the key to tear the cap from the head.

11. A tube (1) accompanied by a cover (20) according to claim 8, in which the base (7) of the cap (5) is connected to the head (2) of the tube (1) in a flared annular depression (80) having a truncated cone shaped lateral surface (18) and in which the cover (20) comprises, at its top, a terminal external cone (25) surrounding its hollow cavity opening, the cone (25) being adapted to fit in said annular depression (80) when the cover (20) is fitted on the cap (5).

12. A tube (1) accompanied by a cover (20) according to claim 11, in which the head (2) of the tube (1) comprises a peripheral annular groove (23) surrounding the annular depression (80), the cover (20) being fixed onto the tube (1) and comprising a depending annular internal rib (22) which engages in the peripheral annular groove (23).

13. A tube (1) according to any of claims 1 to 3 used to store and dispense a liquid intended for ocular or cosmetic purposes.

14. A tube (1) according to claim 7, used for storing a liquid vaccine or a homeopathic liquid, wherein the dish-shaped droplet formation surface (18, 15) formed when the cap has been broken, is adapted to dispense calibrated droplets of the liquid.

15. A tube (1) according to claim 8 used to store and dispense a liquid intended for ocular or cosmetic purposes.

16. A tube (1) according to claim 11 used for storing a liquid vaccine or a homeopathic liquid, wherein the dish-shaped droplet formation surface (18, 15) formed when the cap has been broken, is adapted to dispense calibrated droplets of the liquid.

17. A tube (1) according to claim 12 used for storing a liquid vaccine or a homeopathic liquid, wherein the dish-shaped droplet formation surface (18, 15) formed when the cap has been broken, is adapted to dispense calibrated droplets of the liquid.

18. A tube (1) according to claim 4, wherein the lateral surface (6) is formed by generatrices inclined at less than 10° to the axis of the tube (1) and the tube is accompanied by a cover (20) which is detachably fixed onto the tube (1), the cover (20) covering the cap (5) of the tube (1) without making contact with the cap and comprising a hollow cavity opening at its top and constituting a key (24) adapted to surround and engage a portion of the lateral surface (6) of the cap (5), a portion of the lateral surface (6) of the cap having a surface adapted to be engaged and rotatingly driven by the cover (20), the key having a height which is at least twice the external width of the base of the cap (5) and an inclination to the axis of less than 10°, such that when the cover (20 is removed from the tube, inverted, placed on the cap and rotated, the cap (5) is engaged and rotatingly driven by the cover and is thereby torn from the head.

19. A tube (1) according to claim 7 wherein the arch of the internal surface (11) has a height of less than 1.3 mm, and portions of the surfaces (12), (15) and (18) comprise the orifice of the tube (1) when the cap (5) is torn from the head.

20. A tube (1) accompanied by a cover (20) according to claim 8, the head (2) of the tube (1) being of low density polyethylene selected from the group consisting of low density polyethylene having a density of between 0.88 and 0.93 g/cm$^3$ and of low density linear polyethylene, and the cover (20) being selected from the group consisting of high density polyethylene and polypropylene and being more rigid than the head.

21. A tube (1) made of plastics material having a longitudinal axis (16), a head (2) which has a cylindrical axial internal surface (12), the head being sealed by an integral cap (5) which is connected to the head and adapted to be torn therefrom by twisting to leave an orifice in the head, the cap (5) having a base (7) where the cap (5) is connected to the head (2), an exterior lateral surface (6) of convex planar polygonal contour extending down to the base (7), an internal surface (11) adjoining the cylindrical axial internal surface (12), and being a surface of revolution about the axis and in the form of an arch which extends up into the cap, and a tear zone (10) contained between and defined by the cap convex planar polygonal exterior lateral surface (6), the cap internal surface (11) and the head internal surface (12), the external lateral surface (6) and the internal surface (11) at the connection between the base of the cap and the head providing the tear zone with successive gradually thinning and thickening thin and thick portions (e.g. 14, 14' and 9, 9') extending about the axis (16) in a plane perpendicular to the axis, the tear zone having thin portions each having a minimum thickness of between 0.05 and 0.18 mm and thick portions each having a maximum thickness at least 1.5 times greater than the minimum thickness of the thin portions.

22. A tube (1) made of plastics material having a tubular body having a skirt, a longitudinal axis (16), a head (2) which has a cylindrical axial internal surface (12), the head being joined to the skirt and being sealed by an integral cap (5) which is connected to the head and adapted to be torn therefrom by twisting to leave an orifice having a diameter of 1.2 mm to 4 mm in the head, the cap (5) having a base (7) where the cap (5) is connected to the head (2), an exterior lateral surface (6) of convex planar polygonal contour extending down to the base (7), an internal surface (11) adjoining the cylindrical axial internal surface (12), having successive circular sections perpendicular to the axis and centered relative to the exterior surface, and being a surface of revolution about the axis and in the form of an arch which extends up into the cap, and a tear zone (10) contained between and defined by the cap convex planar polygonal exterior lateral surface (6), the cap internal surface (11) and the head internal surface (12), the external lateral surface (6) and the internal surface (11) at the connection between the base of the cap and the head providing the tear zone with successive gradually thinning and thickening thin and thick portions (e.g. 14, 14' and 9, 9') extending about the axis (16) in a plane perpendicular to the axis, the tear zone having thin portions each having a minimum thickness of between 0.05 and 0.18 mm and thick portions each having a maximum thickness at least 1.5 times greater than the minimum thickness of the thin portions, the thin portions forming sites for initiation of breakage of the cap from the head when the cap is twisted, and the thick portions providing rigidity to the tear zone, the thin and thick portions together providing satisfactory rigidity and tearability to the tear zone, and providing, when the cap is twisted off the head, a breakage surface at the orifice which is adapted to form and dispense droplets when a liquid product intended to be delivered in droplets is dispensed from the tube.

23. A tube (1) according to claim 22 wherein the base of the cap is connected to the head (2) in a flared annular depression (8, 80) of the head (2), the depression having an emergent end whose diameter is less that 7 mm greater than the external width of the base of the cap (5), and having a truncated cone shaped lateral surface (18) which declines from the emergent end toward the axis and the base (7) of the cap (5) and, upon tearing of the cap from the head, extends and localizes breakage substantially along a truncated cone shaped breakage line through the tear zone (10) to form a truncated cone shaped breakage surface (15) of the cap (5), the lateral surface (18) and the breakage surface (15) together forming an extended truncated cone shaped dish-shaped droplet formation surface (15, 18) adjacent the top end of the head (2), which communicates with the internal surface (12) of the head (2), the extended truncated cone shaped dish-shaped droplet formation surface (18, 15) and a portion of the axial internal surface (12) comprising the orifice and allowing the expulsion of metered liquid droplets when the liquid is dispensed from the tube.

* * * * *